US006189266B1

(12) United States Patent
Mihalcheon

(10) Patent No.: US 6,189,266 B1
(45) Date of Patent: Feb. 20, 2001

(54) SAFETY BRAKE MECHANISM FOR OVERHEAD SECTIONAL DOOR

(76) Inventor: Arthur A. Mihalcheon, 74 Valleyview Crescent, Edmonton, Alberta (CA), T5R 5T1

( * ) Notice: Under 35 U.S.C. 154(b), the term of this patent shall be extended for 0 days.

(21) Appl. No.: 09/324,247

(22) Filed: Jun. 2, 1999

(51) Int. Cl.[7] ..... E05D 13/00
(52) U.S. Cl. ..... 49/322; 49/199; 160/201
(58) Field of Search ..... 49/322, 199, 197, 49/200; 160/8, 296, 201; 188/82.34, 82.6, 82.7, 83

(56) References Cited

U.S. PATENT DOCUMENTS

| | | | | |
|---|---|---|---|---|
| 2,185,828 | * | 1/1940 | Blodgett | 49/322 |
| 2,291,583 | * | 7/1942 | Rowe | 49/197 X |
| 2,651,817 | * | 9/1953 | Moler | 49/322 X |
| 2,869,183 | * | 1/1959 | Smith | 49/322 |
| 3,160,200 | * | 12/1964 | McKee et al. | 49/200 X |
| 3,188,698 | * | 6/1965 | Zoll et al. | 49/322 |
| 3,258,062 | * | 6/1966 | Lambert | 160/201 |
| 3,412,780 | * | 11/1968 | Moler | 160/201 X |
| 4,385,471 | | 5/1983 | Gabry et al. . | |
| 5,291,686 | * | 3/1994 | Sears et al. | 49/322 |

FOREIGN PATENT DOCUMENTS 540320 4/1957 (CA) .

* cited by examiner

*Primary Examiner*—Daniel P. Stodola
*Assistant Examiner*—Hugh B. Thompson
(74) *Attorney, Agent, or Firm*—Jennifer L. Bales; Macheledt Bales & Johnson LLP

(57) ABSTRACT

The mechanism comprises a bracket, to which are mounted a fixed roller shaft and a rotatable brake shaft. The roller shaft has a roller which runs in the door track. A cylindrical torsion spring is positioned on the brake shaft. One end of the spring is anchored to the brake shaft. The other end of the spring is connected to a tensioning ring, so that the tension of the spring can be adjusted. The tensioning ring is disengagably secured to the bracket. An arm protrudes from the brake shaft. The lift cable for the door extends through an eye carried by the arm. As long as the cable is taut, the brake shaft is prevented from turning. At its outer end, the brake shaft carries a cam member with braking teeth. The teeth are positioned to bite into the exterior surface of the track if the cable breaks and the spring rotates the brake shaft.

2 Claims, 4 Drawing Sheets

11
23
10
8
9
22
12
6
14
34
1
33
2
26A
26B
28
25
26
21
31
20
20B
15
32
20A
27
18
3
16
4
5
17
13

SAFETY BRAKE MECHANISM FOR OVERHEAD SECTIONAL DOOR

FIELD OF THE INVENTION

The present invention relates to a safety brake mechanism for use at the lower corner of an overhead sectional door.

BACKGROUND OF THE INVENTION

An overhead sectional door assembly commonly involves the following components:

A pair of guide tracks extending vertically up from ground level along each side of the door opening frame, the tracks curving to a horizontal position at the top of the opening;

A sectional door formed of hinging panels and having rotatable rollers attached along the door side edges, whereby the rollers run along the guide tracks as the door is lifted, thereby controlling the positioning of the door. The panels hinge or bend as the door rounds the track curve from vertical to horizontal positions;

A pair of lift cables, each secured to one lower corner of the door. The cables extend up and over cable drums at the top corners of the door frame;

Latch means for locking the door in the lowered position; and

Torsion or extension spring means positioned at the top or along the sides of the door frame and connected with the cables. The spring means function to pull the cables up over the drums, thereby raising the door when the latch means is released.

Now, there is a potential for the cables or lifting spring means to part or fail. If the door is being raised or lowered, this can result in the door dropping and injury or damage may follow.

Safety brake mechanisms have been marketed and patented for stopping the door from falling when tension in the cable is lost. See U. S. Pat. No. 5,291,686, issued to Sears et al, and brochures made of record herewith, as examples of this prior art.

These known safety brake mechanisms typically involve the following components:

a bracket is secured to the lower corner of the door;

the bracket supports a horizontal shaft having a partly toothed disc at one end;

the disc is positioned within the track. The disc has a smooth portion which is in contact with the track so that the disc can glide along the track when the door is in motion. Otherwise stated, the disc functions as a bottom roller for the door;

an arm protrudes from the shaft—the arm has an eye for engaging the lifting cable;

a torsion spring is positioned around the shaft. The spring is anchored at its inner end to a lug attached to the bracket. At its outer end the spring is connected with the shaft.

As long as the cable is taut, the arm is restrained by the cable. The spring is torqued and ready to unwind, but it is prevented from unwinding by its end connections with the lug and shaft. When the cable breaks, the arm is released, the spring rotates the shaft and disc and drives the teeth into the guide track to brake the door and prevent it from dropping.

These known safety brake mechanisms have been associated with problems which have affected acceptance in the market place.

It needs to be understood that there are three different main types of overhead door systems. The first system is referred to as a "standard lift". In this system the door goes immediately into an overhead position as soon as it begins to lift off the floor. The lift cables are initially in tension in an amount equal to the total door weight. This initial tension gradually decreases almost to zero once the door is fully open and entirely horizontal. The second system is referred to as a "hi-lift" assembly. In this case, the door travels upwardly for a pre-determined distance before it begins to travel overhead or horizontally. The lift cables are initially in tension equal to the door weight. This initial tension gradually decreases to equal that portion of the door weight which has not travelled overhead once the door is fully open. In the third system, referred to as the "vertical lift" system, the door travels upwardly without travelling overhead. Therefore the lift cables remain in tension at all times in an amount equal to the total door weight.

In other words, with the standard lift system the cable tension is greatly reduced when the door is fully open, particularly if the door is small and light, whereas the cables in the hi-lift and vertical lift systems always retain appreciable tension when the door is fully open. The known safety brakes work adequately for the hi-lift and vertical lift systems in some situations. However they are unreliable with the standard lift doors because the torsion spring is liable to unwind slightly when the cable is untensioned, causing the teeth to engage the track in a braking action. This is, of course, undesired.

Another problem can arise in situations where an electrically operated motor drives a shaft which carries drums on which the lift cables are wound or unwound. When the electric motor is first started, it has a tendency to cause some slack to arise in the lift cables, which again can undesirably cause the brake to set. This is particularly likely to occur with the standard lift doors.

It is therefore an objective of the invention to provide a safety brake mechanism wherein the tension in the torsion spring can be adjusted to optimize or match the spring to the door assembly with which it is being used, to thereby reduce the likelihood of undesired triggering of the braking action.

For purposes of this description, "outer" denotes furthest from the center of the door, "inner" denotes closest to the center of the door, "rearward" denotes toward the door surface and "forward" denotes away from the door surface.

SUMMARY OF THE INVENTION

In accordance with a preferred form of the invention, a safety brake mechanism is provided comprising:

a bracket for mounting to one lower corner of an overhead sectional door, the bracket having a central web and inner and outer forwardly protruding, parallel legs;

a roller shaft mounted to the legs and carrying a rotatable roller on its outer end for running in the adjacent door guide track, the shaft further carrying a sheave, spaced inwardly from the roller, around which the lifting cable may extend;

the bracket having an upwardly extending section carrying means for anchoring the free end of the lifting cable;

a brake shaft, rotatably mounted to the legs above and forwardly of the roller shaft, the brake shaft being positioned to clear the forward end wall of the track and to be forwardly spaced therefrom;

the brake shaft carrying a cam member having at least one downwardly and rearwardly directed tooth, for engaging the outer surface of the forward end wall of the track, and an arm having an eye through which the anchored end of the cable extends as it passes around the sheave;

the brake shaft carrying a torsion spring secured at its outer end to spring-anchoring means attached to the shaft and at its inner end to spring-tensioning means secured to the inner leg of the bracket.

The resulting assembly is characterized by:

the utilization of two spaced apart shafts, the rear shaft carrying the roller for controlling the positioning of the door, bracket and breaking teeth relative to the track, the forward shaft locating the cam member and teeth outside the track and ensuring that the positioning of the teeth is fixed relative to the roller, so that improved clearance is created and the teeth are better kept from contacting the track at its curve;

the cam member functioning to bring the teeth into contact with the track in an angular position so that the door weight will then drive the teeth firmly into the track with a wedging biting action, when the torsion spring is released; and the utilization of a tensioning device on the brake shaft, for varying the tension of the spring to better match it with the type of lift involved and the weight of the door used.

Broadly stated, the invention comprises, in combination, an overhead sectional door, having a side edge and bottom corner; a guide track mounted beside the door for guiding the door, said track having a front end wall; a tensioned lift cable for lifting the door from the bottom corner; and a safety brake mechanism comprising a bracket attached to the lower corner of the door adjacent the track; a roller shaft having inner and outer ends, the roller shaft being mounted to the bracket and carrying a rotatable roller at its outer end, the roller being positioned to run in the track, a brake shaft having a longitudinal axis and inner and outer ends, the brake shaft being rotatably mounted to the bracket so that it is adapted to rotate about its axis between non-braking and braking positions, the outer end of the brake shaft having a cam member secured thereto, the cam member having at least one downwardly and rearwardly directed operative to angularly engage the front end wall of the track with a wedging biting action when the brake shaft rotates to the braking position; an arm protruding upwardly from the brake shaft inwardly of the cam member and having means for engaging with the lift cable, a torsion spring mounted on the brake shaft, means, rotatably mounted on the brake shaft and being connected with one end of the torsion spring, for adjusting the tension of the spring, said means being disengagably secured to the bracket to affix said one spring end, means for affixing the other end of the torsion spring to the brake shaft, the brake shaft being positioned upward and forwardly of the roller shaft so that the roller is positioned in the track and the teeth are positioned outside and forwardly of the track, so that the spring will normally urge the brake shaft to rotate to bring the teeth into angular engagement with the track front end wall but the arm will prevent such rotation as long as the lift cable with which it is engaged is tensioned.

DESCRIPTION OF THE PREFERRED EMBODIMENT

Figure 1:
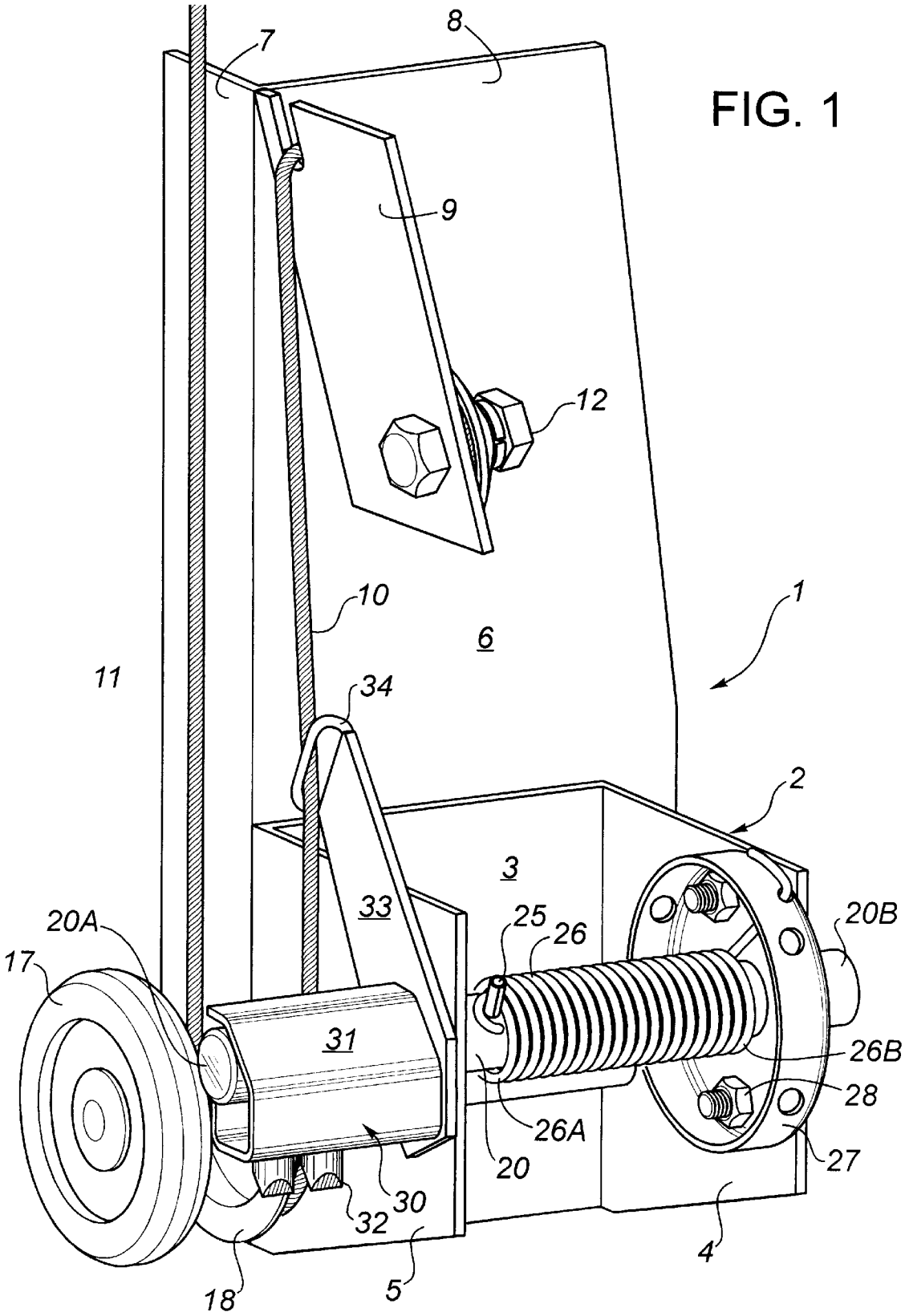
FIG. 1 is a perspective front view of the brake mechanism, showing the lifting cable in the normal tensioned state.
Figure 2:
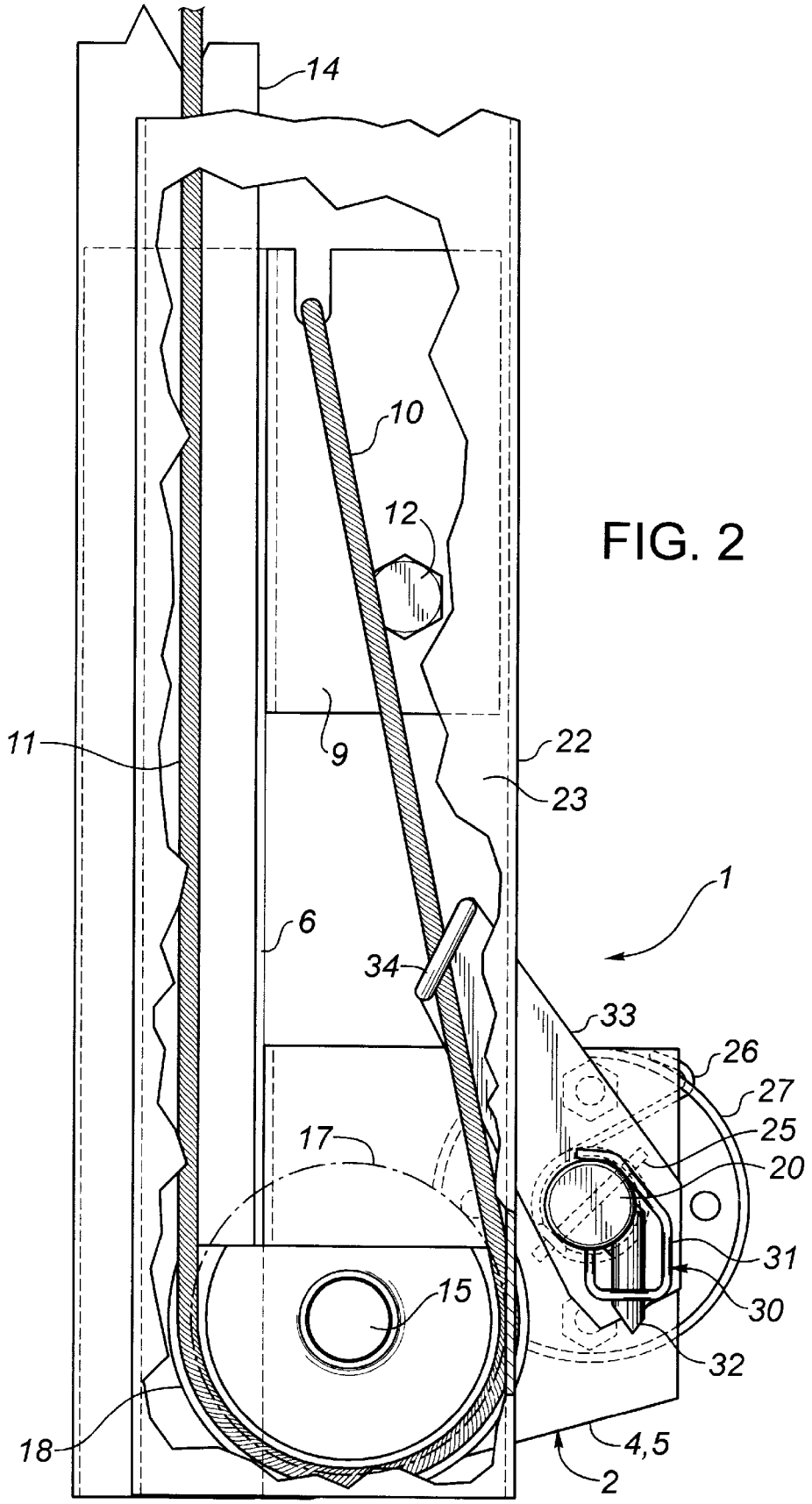
FIG. 2 is a side view, partly broken away, showing the mechanism with lifting cable in the tensioned state and the brake teeth in a non-braking position.

The brake mechanism 1 comprises a bracket 2 having a central web 3 and inner and outer legs 4,5. The legs 4,5 protrude from the web 3 in spaced apart, parallel relationship. The bracket 2 further comprises an upwardly projecting plate 6 having an inwardly projecting side edge portion 7 and a main portion 8. A forwardly projecting portion 9 extends from the main portion 8, for anchoring the free end 10 of the lift cable 11 with nut and bolt assembly 12. The bracket 2 is mounted to the lower corner 13 of sectional door 14. The bracket edge portion 7 abuts the side edge of the door 14; the main portion abuts the front surface of the door.

A horizontal roller shaft 15 is mounted to the bracket legs 4,5 and is retained in place by cotter pin 16. A roller 17 is rotatably carried on the outer end 15*a* of the shaft 15. A sheave 18 is carried by the shaft 15 inwardly of the 24 roller 17.

The roller 17 is positioned to run in the guide track 23 extending alongside the side edge of the door 14.

A brake shaft 20 is rotatably mounted to the bracket legs 4,5 and is retained in place by cotter pin 21. The brake shaft is free to turn in the openings formed in the legs 4,5, through which it extends.

The brake shaft 20 is positioned forwardly of and upwardly from the roller shaft 15. Its outer end 20*a* is clear of and spaced forwardly from the front surface 22 of the track 23.

An anchoring pin 25 extends through the brake shaft 20, inwardly of the bracket outer leg 5. A cylindrical torsion spring 26 is mounted on the brake shaft 20 between the legs 4,5. The outer end 26*a* of the spring is anchored to the pin 25. The inner end 26*b* of the spring is anchored to a spring-tensioning ring 27 screw-threaded on to the threaded end 20*b* of the shaft 20. The ring 27 can be rotated as required to tension the torsion spring 26 to a desired extent. Once set, it is locked to the inner leg 4 by nut and bolt assemblies 28.

A tooth/cam assembly 30 is secured to the outer end 20*a* of the brake shaft 20. The assembly 30 comprises a cam member 31 carrying teeth 32 aligned with the track 23. The teeth 32 extend downwardly and rearwardly toward the front surface 22 of the track 23.

An arm 33 extends upwardly and rearwardly from the support member 31 and has an eye 34 at its upper end. The cable free end 10 extends around the sheave 18, through the eye 34 on the arm 33 and is secured to the bracket portion 9 by the nut and bolt assembly 12.

Figure 3:
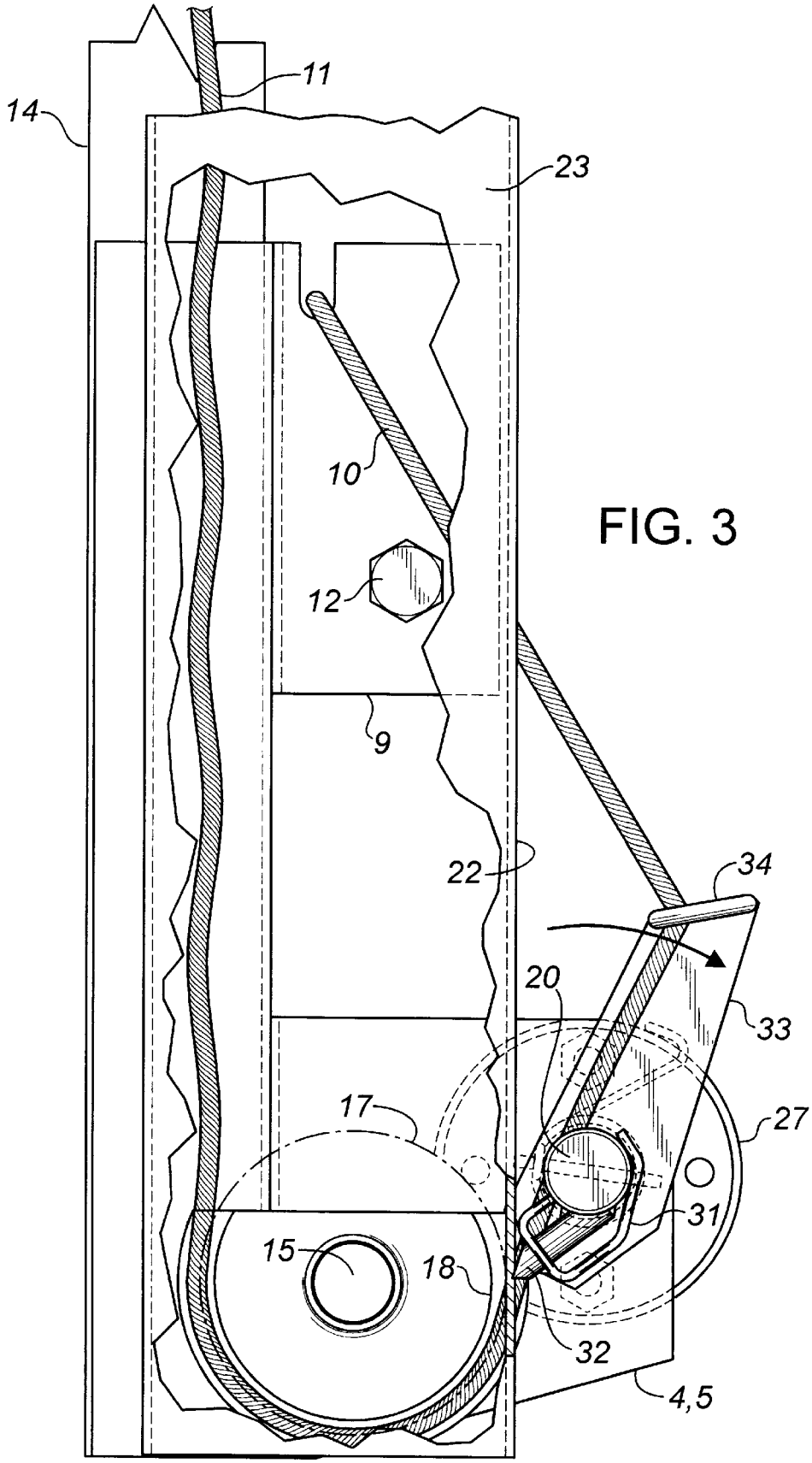
FIG. 3 is a side view similar to FIG. 2, however the lifting cable is now loose and the breaking teeth have assumed the braking position.
Figure 4:
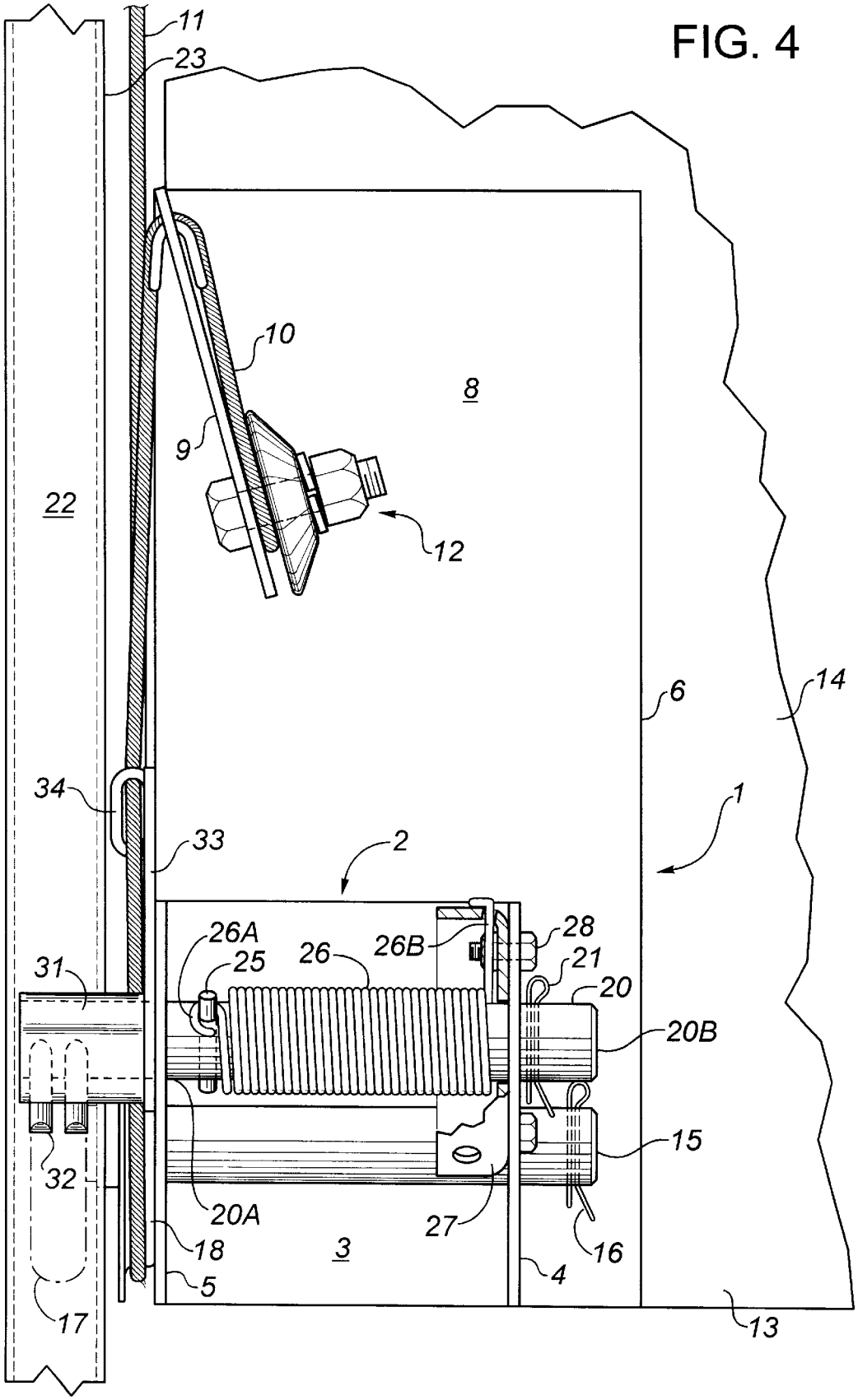
FIG. 4 is a front view of the mechanism with the lifting cable in the tensioned or taut state.

In use, the arm 33 is normally fixed by its attachment to the cable free end 10. In this condition, the teeth 32 are retained in a non-breaking position, out of contact with the front surface 22 of the track 23. However, when the cable breaks, the spring 26 turns the brake shaft 20 and cam member 31 clockwise to bring the teeth 32 into angular engagement with the track 23. The weight of the door 14 will then drive the teeth 32 into the track 23 with a wedging biting action, as illustrated in FIG. 3.

The invention utilizes two shafts, mounted to the bracket, to enable and maintain the spacing of the teeth relative to the track. It further uses the released spring, rotatable brake shaft and cam member to bring the teeth into a wedging, angular position against the track, so that the weight of the door will cause the teeth to bite into the door. And it further uses the spring-tensioning ring to adjust the tension of the torsion spring so that it is tailored to the weight of the door.

While the foregoing description sets forth applicant's best mode of the invention, it will be apparent to those skilled in the art that various modifications may be made to the invention without departing from the spirit and scope of the invention.

The embodiments of the invention in which an exclusive property or privilege is claimed are defined as follows:

1. A safety brake mechanism for use at the lower corner of an overhead sectional door having rollers running in guide tracks positioned at each side of the door, each track having a front end wall, the door being lifted by tensioned lift cables extending upwardly from its lower corners, comprising:

a bracket for attachment to one lower corner of the door adjacent one of the tracks;

a brake shaft having a longitudinal axis and inner and outer ends, the brake shaft being rotatably mounted to the bracket so that it is adapted to rotate about its axis between non-braking and braking positions, the outer end of the brake shaft having a cam member secured thereto, the cam member having at least one tooth, positioned below the brake shaft, downwardly and rearwardly directed toward the door surface, at its outer end, operative to angularly engage the front end wall of the adjacent track with a wedging biting action when the brake shaft rotates to the breaking position;

an arm protruding upwardly from the brake shaft inwardly of the cam member, the arm having means for engaging with a lift cable;

a torsion spring mounted on the brake shaft;

means, rotatably mounted on the brake shaft and being connected with one end of the torsion spring, for adjusting the tension of the spring, said means being disengagably secured to the bracket to affix said one spring;

means for affixing the other end of the torsion spring to the brake shaft;

the brake shaft being positioned upwardly and forwardly of the roller shaft so that, when mounted to a door in use, the roller can be positioned in the adjacent track and the teeth are positioned outside and forwardly of the track;

so that the spring will normally urge the brake shaft to rotate to bring the teeth into angular engagement with the track front end wall but the arm will prevent such rotation as long as the lift cable with which it is engaged is tensioned.

2. In combination:

an overhead sectional door, having a side edge and a bottom corner;

a guide track mounted beside the door for guiding the door along its side edge, said track having a front end wall;

a tensioned lift cable for lifting the door from the bottom corner; and a safety brake mechanism comprising a bracket attached to the lower corner of the door adjacent the track;

a roller shaft having inner and outer ends, the roller shaft being mounted to the bracket and carrying a rotatable roller at its outer end, the roller being positioned to run in the track;

a brake shaft having a longitudinal axis and inner and outer ends, the brake shaft being rotatably mounted to the bracket so that it is adapted to rotate about its axis between non-braking and braking positions, the outer end of the brake shaft having a cam member secured thereto, the cam member having at least one tooth, positioned below the brake shaft, downwardly and rearwardly directed toward the door surface, operative to angularly engage the front end wall of the track with a wedging biting action when the brake shaft rotates to the breaking position;

an arm protruding upwardly from the brake shaft inwardly of the cam member, the arm having means for engaging with the lift cable;

a torsion spring mounted on the brake shaft;

means, rotatably mounted on the brake shaft and being connected with one end of the torsion spring, for adjusting the tension of the spring, said means being disengagably secured to the bracket to affix said one spring end;

means for affixing the other end of the torsion spring to the brake shaft;

the brake shaft being positioned upwardly and forwardly of the roller shaft so that the roller is positioned in the track and the teeth are positioned outside and forwardly of the track;

so that the spring will normally urge the brake shaft to rotate to bring the teeth into angular engagement with the track front end wall but the arm will prevent such rotation as long as the lift cable with which it is engaged is tensioned.

* * * * *